United States Patent [19]

Blessing et al.

[11] 3,951,400

[45] Apr. 20, 1976

[54] CLOTH MOVER AND STACKER

[75] Inventors: Hubert Blessing, Dallas, Tex.; Robert D. Eckerson, Trumbull; Alfred E. Mally, Fairfield, both of Conn.

[73] Assignee: Levi Strauss & Co., San Francisco, Calif.

[22] Filed: Aug. 12, 1974

[21] Appl. No.: 496,522

[52] U.S. Cl. ..... 271/85; 214/1 BB

[51] Int. Cl.[2] ..... B65H 29/10

[58] Field of Search ..... 271/85, 84, 65, 186, 271/204, 206, 268; 214/6 D, 1 BB; 112/DIG. 1

[56] References Cited

UNITED STATES PATENTS

| | | | |
|---|---|---|---|
| 1,426,033 | 8/1922 | Barber | 271/206 X |
| 2,781,136 | 2/1957 | Sehn et al. | 214/1 BB |
| 3,199,653 | 8/1965 | McGowan | 271/85 X |
| 3,815,898 | 6/1974 | Haifley et al. | 271/65 |
| 3,831,932 | 8/1974 | Conrad | 271/85 |

*Primary Examiner*—Evon C. Blunk
*Assistant Examiner*—Bruce H. Stoner, Jr.
*Attorney, Agent, or Firm*—Limbach, Limbach & Sutton

[57] ABSTRACT

A carriage is moved on an ell shaped frame by a pneumatic actuator and a curved gripping device at the end of an ell shaped extension mounted on the carriage is operated by a second pneumatic actuator to pick up pieces of web material. The pneumatic actuator for the carriage is controlled by a sequence valve so as to not be movable until the gripper has gripped the web of material. A third pneumatic actuator thereafter moves the carriage at a relatively fast initial movement until the web of material has cleared the sewing machine. The carriage movement is slowed and this carriage moves the web of material to a predetermined location where it is released by the gripper to fall in a stack.

9 Claims, 7 Drawing Figures

84
88
86
66
68
62
56
64
58
60
"REMOVE" SIGNAL
80
90
82
70
COMPRESSED AIR SOURCE
92
94
96
98
100
102
74
76
SW.
52
38
40
36

84
86
88
66
68
"REMOVE" SIGNAL
78
80
90
62
56
64
58
60
70
82
92
COMPRESSED AIR SOURCE
96
94
98
100
102
74
76
52
SW.
110
40
106
112
SW.
T. D.
36
38
108
F. F.
114

CLOTH MOVER AND STACKER

BACKGROUND OF THE INVENTION

The invention pertains to a mechanism for moving a length of web material, more particularly to a mechanism developed to move a piece of cloth from one position to another, accurately and with a controlled motion that can be related to other operations being performed on the cloth. In the garment industry, it is necessary to have a mechanical device which will remain at rest until a piece of cloth is in a position to be moved. Upon receipt of the control signal indicating this condition, the mechanism must grip the cloth and move it a predetermined distance where it is to be released to fall in a stack. If successive pieces of cloth are moved and released a stack will be formed at the release point. It is necessary that each piece of cloth be located accurately with respect to the piece before it. The location of the gripping, the location of the release, the distance to be moved, and the rate of movement must be variables that can be preset into the mechanism. Commercial "stackers" for the garment industry to carry out these functions will only perform some but not all of them. Furthermore, such prior art stackers are inaccurate, unreliable, difficult to control, and require too much space.

SUMMARY OF THE INVENTION

The above and other disadvantages are overcome by the present invention of a mechanism for gripping and moving lengths of web material from a working surface, comprising a frame, a carriage movable on the frame, means for selectively moving the carriage on the frame, a first extension member attached to the carriage, gripper means mounted on the distal end of the first extension member from the carriage for gripping the lengths of web material, and means for activating the gripper means. The carriage moving means are responsive to the gripper activating means such that the carriage is moved only after the gripper means are activated. The carriage moving means initially move the carriage at a first speed for a predetermined time after the gripper means are activated and then move the carriage at a second speed which is slower than the first speed. This change in speed allows slack to occur in the thread which connects the web length to the sewing machine. The slack thread is pulled by a vacuum into a thread cutter which then cuts the length of web free.

The gripper means comprise a second extension member having a curved portion at one end and being attached at its other end to the distal end of the first extension member. The curved portion has an outer curved surface for sliding over the lengths of web material on the working surface. A clamping member is pivotally mounted on the second extension member adjacent to the curved portion and has one U-shaped end which can lift an edge of a length of web material and press it against the outer surface of the curved portion when the U-shaped end of the clamping member is caused to pivot towards the curved portion. First pneumatic actuator means selectively cause the clamping member to pivot towards the curved portion to grip the edge of the web material. The location of attachment of the second extension member to the first extension member is adjustable so that the gripper means can be positioned for optimum contact with the web material.

Although there are many applications for this cloth moving mechanism, it is primarily designed to be attached to an industrial sewing machine stand and is used to move a sewn piece of cloth from the sewing machine to a stack which is confined in a tote box. The mechanism is supported by a simple tubular steel frame which is ell shaped and which acts as a guide for the motion of the mechanism. It also provides a support for the end of the cloth moving mechanism which is opposite from the sewing machine stand. The mechanism comprises a carriage which rides on the horizontal leg of the ell shaped frame. At each end of the horizontal leg of the frame are two end plates. Two roller followers are attached to the carriage and ride on a bar attached to the frame to prevent any rotation of the carriage around the horizontal leg of the frame. The carriage is caused to move along the horizontal leg of the frame by a second air cylinder whose actuator rod is coupled to the carriage through a cable and pulley system. The mechanical advantage of the cable-pulley system provides a two-to-one ratio between the carriage movement to the actuator rod movement.

The extent of carriage travel is limited by clamp type collars on the horizontal leg of the frame which are fitted with rubber bumpers to reduce shock. Carriage reversal is caused by contact with a limit switch mounted on a clamp collar at the end of the horizontal leg of the frame adjacent to the top of the stack of cloth.

The motion of the gripper clamping lever and the movement of the carriage must be sequenced with the movement of the cloth in the sewing machine. In the preferred embodiment, a signal from an electronic pulse counter, which is connected to count the number of sewing stitches, for example, actuates a solenoid valve to supply pressurized air to the small actuator which pivots the gripper clamping lever. The pivoting action of the clamp lever must be completed before the carriage moves. This is accomplished through the use of a sequence valve which controls a separate air supply to the cylinders which moves the carriage. The sequence air valve operates only after pressure has built up in the air lines to the gripper clamping lever actuator. Only a small pressure is required to operate the gripper clamping lever actuator and therefore the pressure built up to operate the sequence valve does not occur until the gripper clamping lever has completed its stroke.

The air flow in the actuator circuit which moves the carriage is actually directed in parallel to two air cylinders in the preferred embodiment. The smaller of the two air cylinders, referred to herein as the booster cylinder, provides a quick, initial movement of the carriage, and thus the gripper and the cloth held by it, of approximately two inches. This moves the length of cloth to clear the access to the thread cutter. While the cloth hesitates after the initial motion, the thread can be cut, and the cloth can then be moved over the stack and released by the gripper. The motion required to move the length of cloth to the stack is delayed only by the time required to build up pressure in the second and larger air cylinder which primarily moves the carriage. The air flow to this cylinder is controlled during the remainder of its stroke to provide smooth flow of the cloth to the stack. A rapid movement would create uneven stacks and might even fold the pieces of cloth.

It is thus an object of the invention to provide a mechanism which will automatically move strips of cloth material from a sewing machine to a stack;

It is another object of the invention to provide a cloth strip moving mechanism in which the cloth moving means does not move until the cloth is firmly gripped;

It is another object of the invention to provide a cloth stacking and moving mechanism in which two different speeds of cloth movement during retraction are available to facilitate thread cutting with an under trimmer; and It is still another object of the invention to provide a cloth moving and stacking mechanism in which the cloth release positions may be selectively controlled.

These and other features and advantages will become more apparent upon consideration of the following specification taken in conjunction with the accompanying drawings wherein similar characters of reference refer to similar structures in each of the several views.

DESCRIPTION OF CERTAIN PREFERRED EMBODIMENTS

Figure 1:
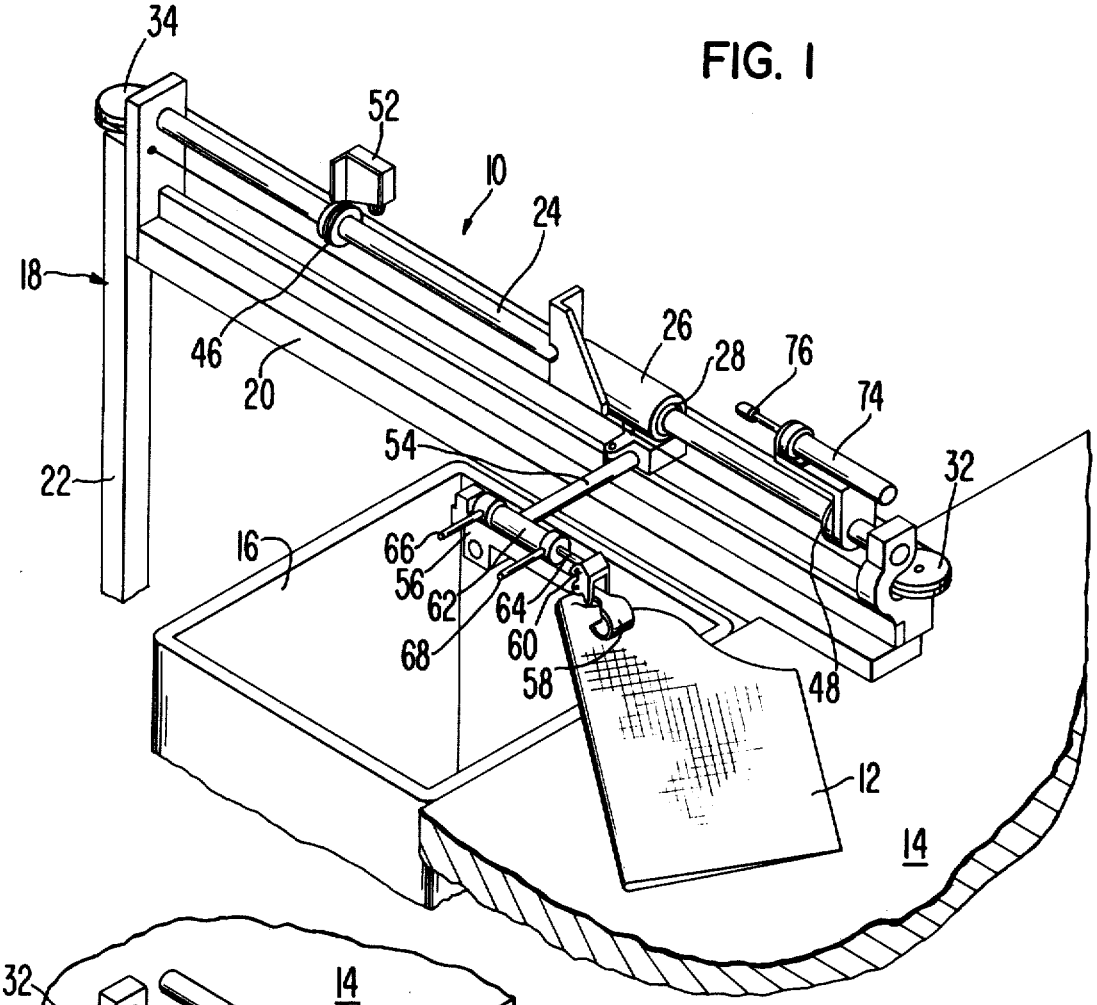
FIGS. 1 and 2 are perspective views of the opposite sides of the cloth moving and stacking mechanism of the invention.

Referring now more particularly to FIG. 1, the cloth moving and stacking mechanism of the invention designated by the reference numeral 10 is designed to move a strip of cloth 12 from a working surface 14 into a tote box 16 positioned adjacent to the working surface 14. The cloth moving and stacking mechanism is supported by a simple, ell shaped, steel frame 18 which has a horizontal leg 20 and a vertical leg 22. The lower end of the vertical leg 22 stands on the floor and the free end of the horizontal leg 20 is supported by the working surface 14. A tubular member 24 is mounted on the frame directly above and parallel to the horizontal leg 20. A carriage 26 is slidably mounted on the tubular member 24. Two ball bushings 28 are impressed into the carriage 26 to provide friction-free movement on the longitudinal shaft 24. The length of the longitudinal shaft 24 is approximately thirty inches. A pair of roller followers are attached to the bottom of the carriage 26 and straddle the upper edge of the horizontal leg 20 to prevent any rotation of the carriage about the longitudinal support shaft 24.

Figure 2:
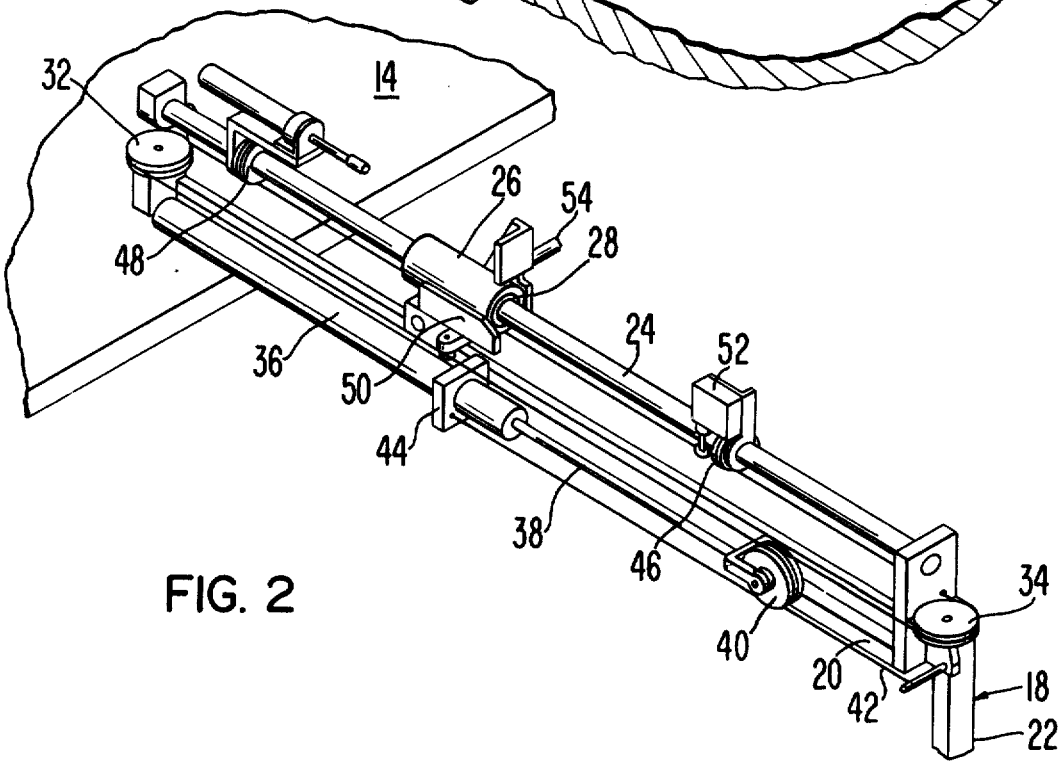
Figure 3:
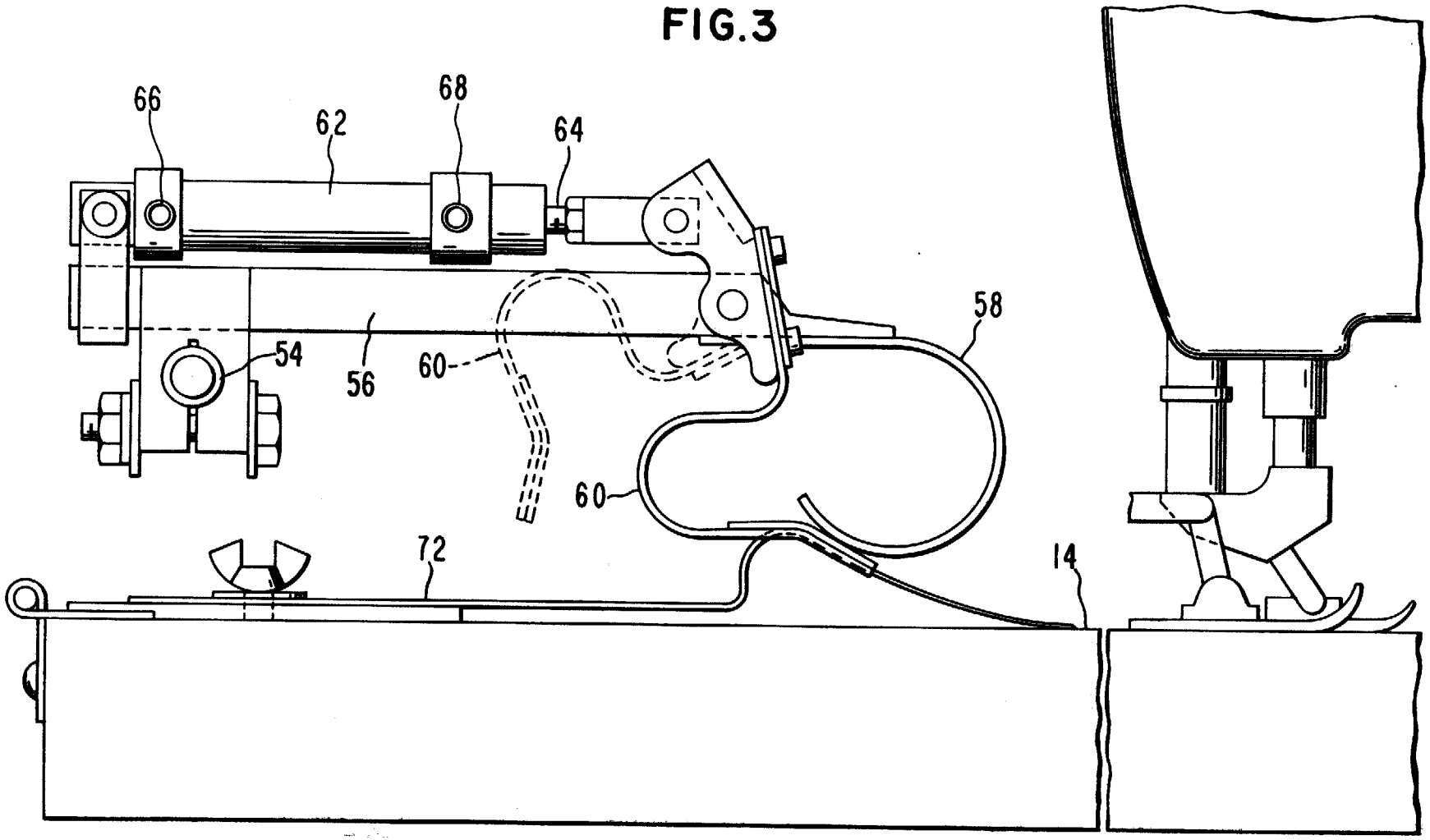
FIG. 3 is an enlarged side view in elevation of the gripping mechanism of the embodiment depicted in FIGS. 1 and 2 together with a portion of the sewing machine with which the mechanism is intended to be used.
Figure 4:
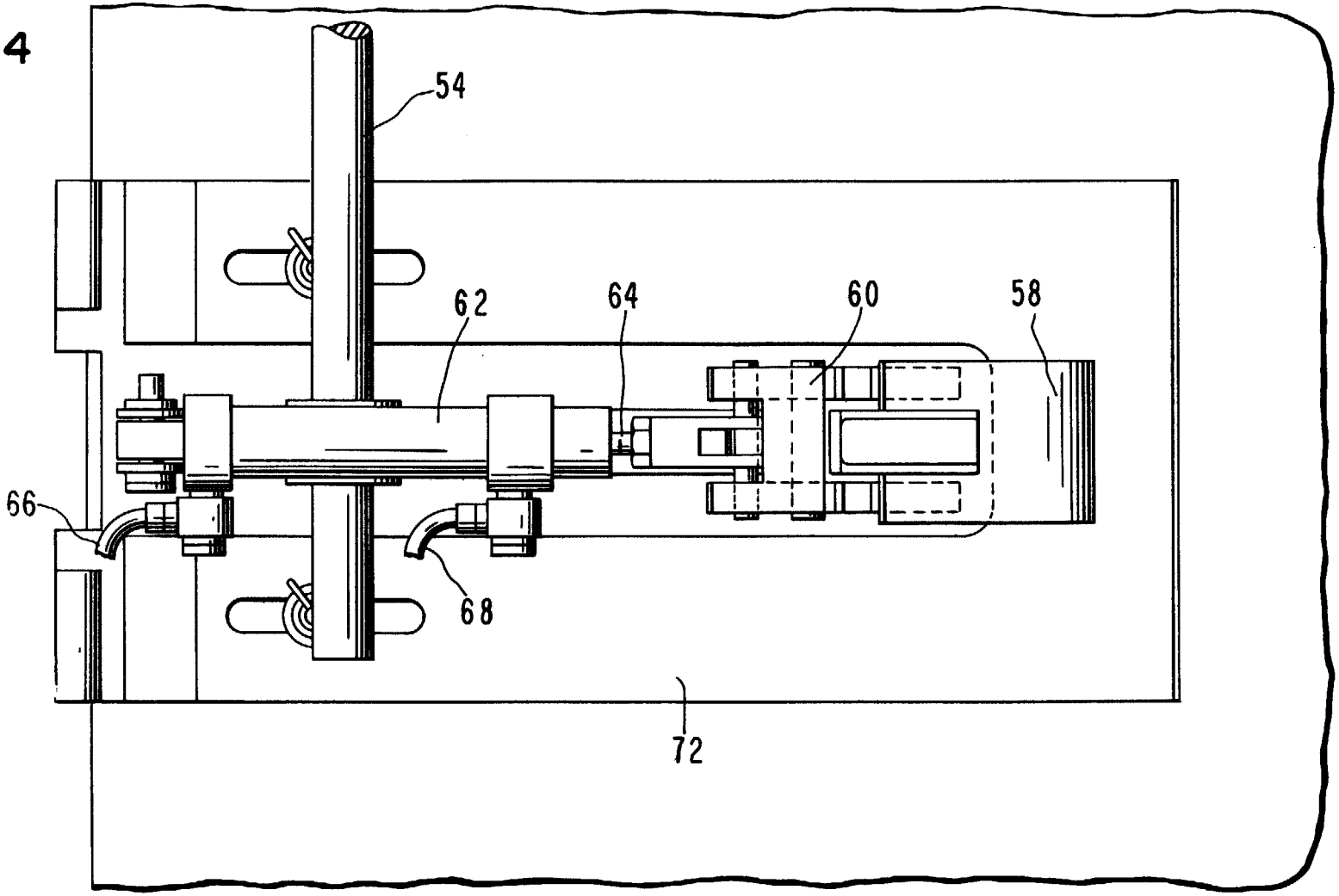
FIG. 4 is an enlarged plan view of the gripping mechanism depicted in FIG. 3.

A pair of pulleys 32 and 34 are horizontally mounted on the upper surface of the opposite ends of the horizontal frame leg 20. An air cylinder actuator 36 is mounted to the frame leg 20 at the end nearest to the working surface 14. The air cylinder 36 has an actuator rod 38 which is horizontally extendable towards the vertical leg 22 of the frame. The pulley 32 is mounted nearest to the working surface 14 and the pulley 34 is mounted nearest to the vertical frame leg 22. A double pulley 40 is vertically mounted on the distal end of the actuator rod 38. A cable 42 is attached at one end to the end of the frame leg 20 beneath the pulley 34 and extends clockwise around the pulley 40 as viewed in FIG. 2 and then counterclockwise around the pulley 34, also as viewed in FIG. 2. The cable continues parallel to the leg 20 and is attached to the carriage 26. It continues on around the pulley 32 in a counterclockwise direction, as viewed in FIG. 2, passes around the pulley 40 in a clockwise direction, in a separate second groove. This end of the cable 42 is attached to a bracket 44 which supports the air cylinder 36. Because the cable 42 is looped around the movable pulley 48 a two-to-one mechanical advantage is thereby obtained. That is, for every inch of travel of the pulley 40 the carriage will travel two inches on the rod 24.

The extent of travel of the carriage 26 toward the pulley 34 is limited by a collar 46 which is clamped onto the end of the tubular support rod 24. The extent of carriage travel in the direction toward the working surface 14 is limited by a collar 48 which is clamped onto the tubular support rod 24 nearest the pulley 32. Both of the collars 46 and 48 have rubberized cushions to reduce shock.

A horizontal camming member 50 is attached to the carriage 26. A reversal switch 52 is mounted on the horizontal support bar 24 adjacent the collar 46. As it will be explained in greater detail hereinafter, the actuation of the reversal switch 52 causes the pneumatic cylinder 36 to retract the control rod 38 and the pulley 40 and to thus reverse the direction of travel of the carriage 26.

A first extension bar or member 54 is clamped onto the carriage 26 perpendicular to the direction of travel of the carriage. At the distal end of the extension bar 54 from the carriage 26 a second extension bar or member 56 is clamped onto the first extension bar 54. At the end of the extension bar 56 which is distal from the connection between the bars 54 and 56 is a fixed curved member 58 which has an outer curved surface to ride up and over the lengths of cloth 12. A clamping lever 60 is pivoted to the extension member 56 adjacent to the curved end 58. The clamping lever 60 is pivotally actuated by a pneumatic cylinder 62 mounted on the upper surface of the extension member 56. The pneumatic cylinder 62 has an extension rod 64 which is pivotally attached to the upper end of the clamping lever 60. The pneumatic cylinder 62 is connected at opposite ends by a pair of pneumatic lines 66 and 68, respectively, to a compressed air source 70 (FIG. 5) which extends and retracts the rod 64 to pivot the clamping lever 60 against the curved surface of the curved member 58 and thereby grip the length of the cloth 12.

As the cloth 12 exits from the sewing machine, it is moving in a horizontal plane across the work surface 14, therefore, to facilitate the clamping action between the clamping lever 60 and the fixed curved member 58, a ramp shaped gripper aide 72 is mounted on the horizontal working surface to lift the leading edge of the cloth piece 2 into a position that is approximate to the underside of the curved surface of the fixed member 58. The clamping lever 60 can thus get under the edge of the cloth 12 and clamp it tightly to the fixed member 58.

The motion of the gripper clamping lever 60 and the movement of the carriage 26 must be sequenced with the movement of the cloth in the sewing machine. This is necessary in order to sever the sewing thread between the machine and the piece of cloth 12. Typically, this is done by withdrawing the piece of sewn cloth from the sewing machine and then allowing slack to develop in the thread between the machine and the cloth. This thread slack is then sucked down over an oscillating knife, known in the trade as an under trimmer, which severs the slack thread, thereby freeing the sewn cloth piece from the machine. This slack in the thread is achieved in the present mechanism by withdrawing the cloth piece 12 at an initially fast rate for a short distance and then pausing momentarily before resuming the retraction process at a slower rate of speed. The initial fast rate of speed is applied by means of a smaller, pneumatic booster actuator 74 mounted at the working surface end of the support rod 24. The booster actuator 74 has an extension rod 76 which is positioned to contact the carriage 26 when the rod 76 is extended and the carriage 26 is at the working surface end of the support rod 24.

Figure 5:
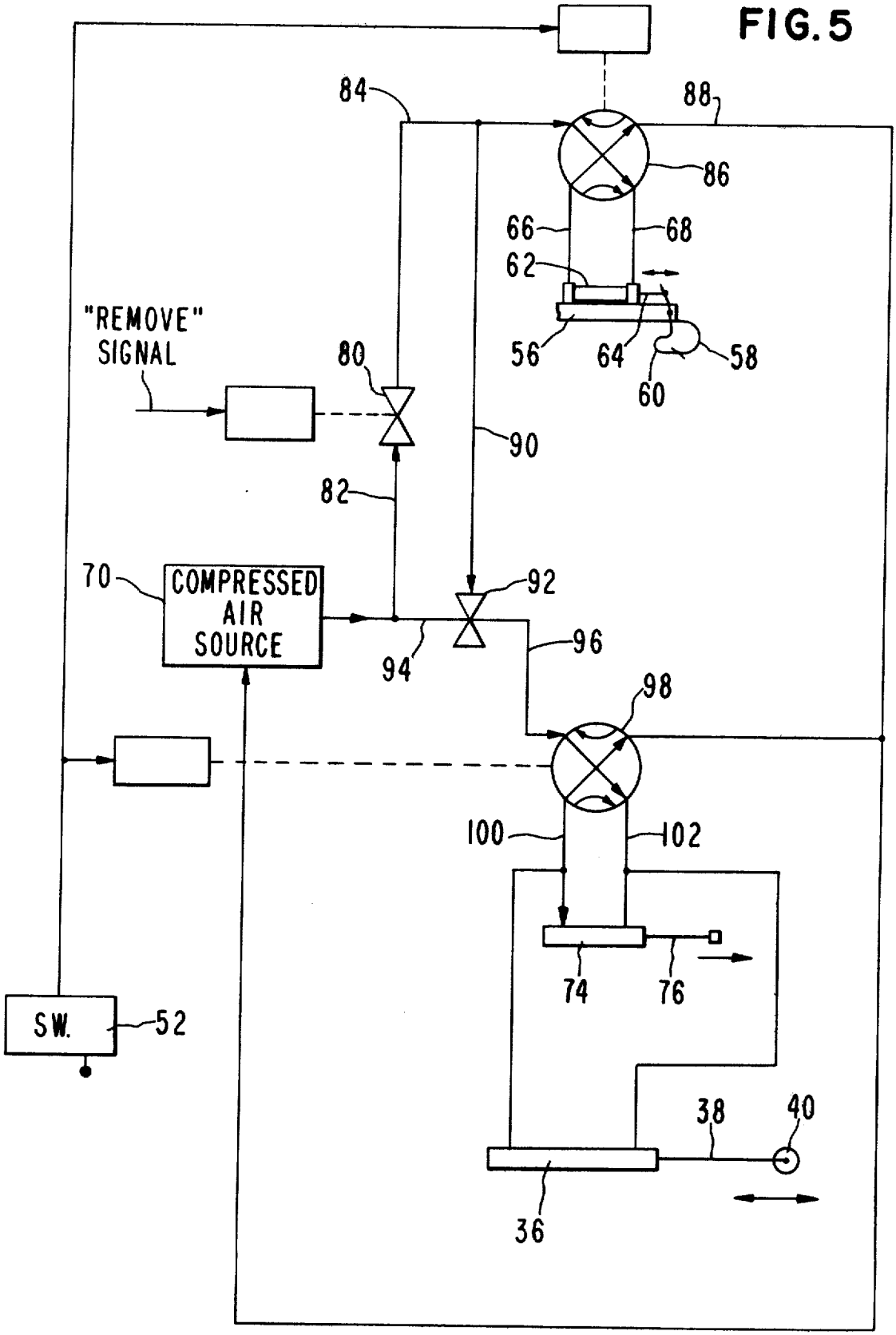
FIG. 5 is a diagram of the control system for the embodiment depicted in FIG. 1.

Referring now more particularly to FIG. 5, the control system for the mechanism will be described in greater detail. An electronic stitch counter (not shown) on the sewing machine generates a "remove" signal which actuates an electromechanical valve 80. The valve 80 may be a solenoid operated type valve, for example. The valve 80 is connected on one side by a pneumatic line 82 to the source of compressed air 70 and on its other side by a pneumatic line 84 to one input of a four-way valve 86. The other input to the valve 86 is a return pneumatic line 88 to the compressed air source 70. The two outputs of the four-way valve 86 are connected to the pneumatic, operating lines 68 and 66 of the pneumatic, gripper actuator 62. When the four-way valve 86 is in a first position, as depicted in FIG. 5, the generation of the remove signal which opens the valve 80 causes compressed air to enter the cylinder 62 and retract the rod 64, thereby pivoting the clamping lever 60 against the curved member 58 and firmly gripping the edge of the piece of cloth 12.

In order to insure that the carriage 26 is not moved prior to the gripping of the piece of cloth 12, a pneumatic line 90 is connected between the line 84 and a control input to a sequence valve 92. The sequence valve 92 is connected on one side by a pneumatic line 94 to the compressed air source 70 and on its other side by a pneumatic line 96 to one input of a second four-way valve 98. The other input to the four-way valve 98 is the return line 88. The two outputs from the four-way valve 98 are connected by pneumatic lines 100 and 102 to the two pneumatic actuators 36 and 74 connected in parallel.

The sequence valve 92 opens only after pressure has built up in the air lines 84 and 90 to a predetermined valve which indicates that the pneumatic actuator 62 has been completely activated. Only a relatively small pressure is required in the actuator 62 to move the clamping lever 60 and therefore, the pressure built up in the lines 84 and 90 which is necessary to operate the sequence valve 92 does not occur until the clamping lever 60 has completed its pivotal stroke. The air flow in the second, parallel circuit in the pneumatic lines 100 and 102 operates both of the pneumatic actuators 36 and 74, however, the actuator 74 is dimensioned such that its extension rod 76 moves at a relatively fast rate as compared with the rate of movement of the extension rod 44. The rod 76 moves the carriage 26 quickly over a distance of approximately two inches after which there is a hesitation of a few microseconds. During this hesitation period the thread is sucked into the under trimmer and severed, thereby freeing the cloth. The motion required to move the cloth to the stack is thus delayed only by the time required to build up pressure in the second and larger cylinder 36. Air flow is thereafter controlled during the remainder of the stroke of the rod 44 to provide smooth flow of the cloth 12 to a stack. Rapid movement of the carriage 26 is undesirable since it tends to create uneven stacks and may even fold the pieces of cloth.

Figure 6:
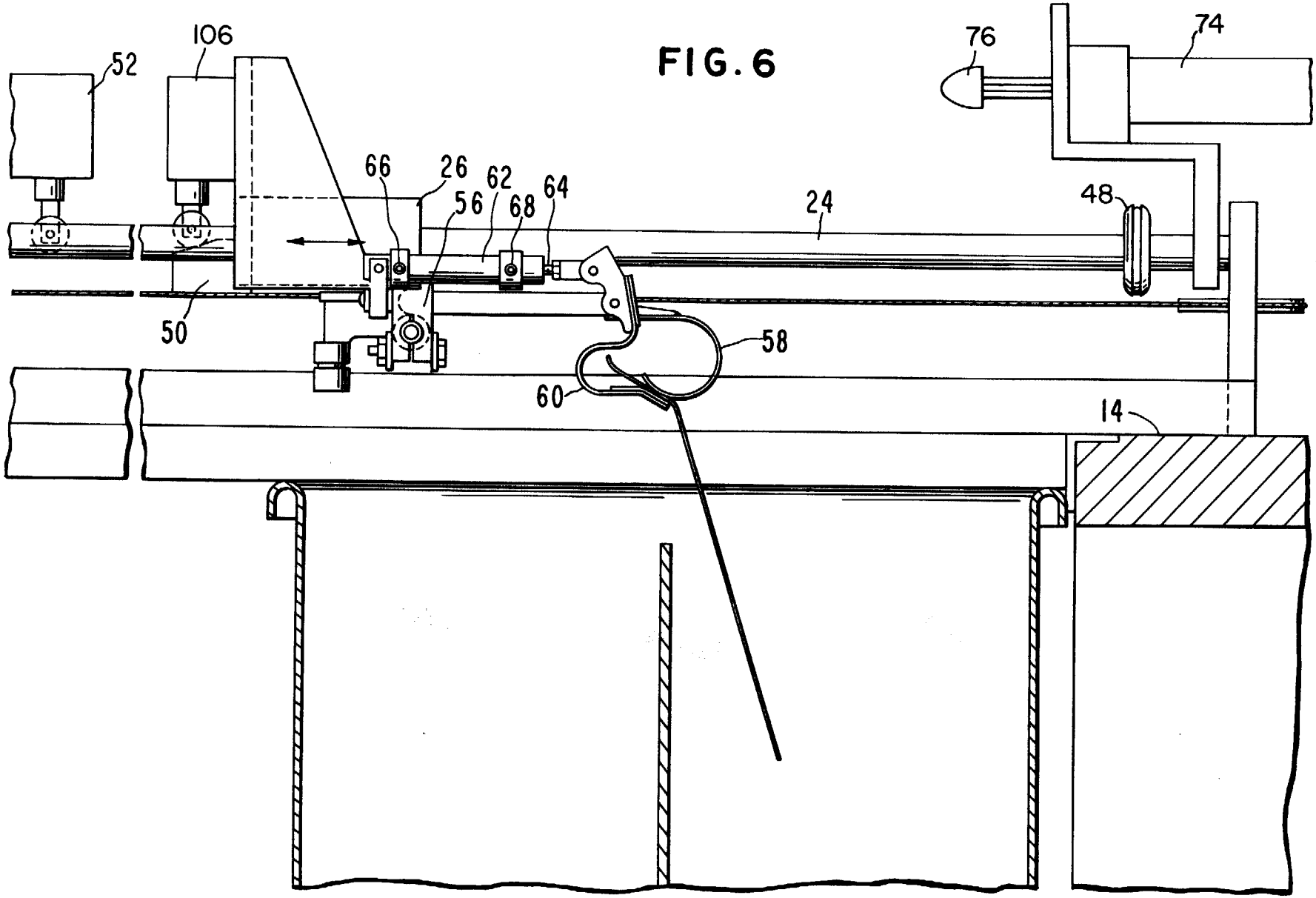
FIG. 6 is an elevational view of a modification of the embodiment of FIG. 1.
Figure 7:
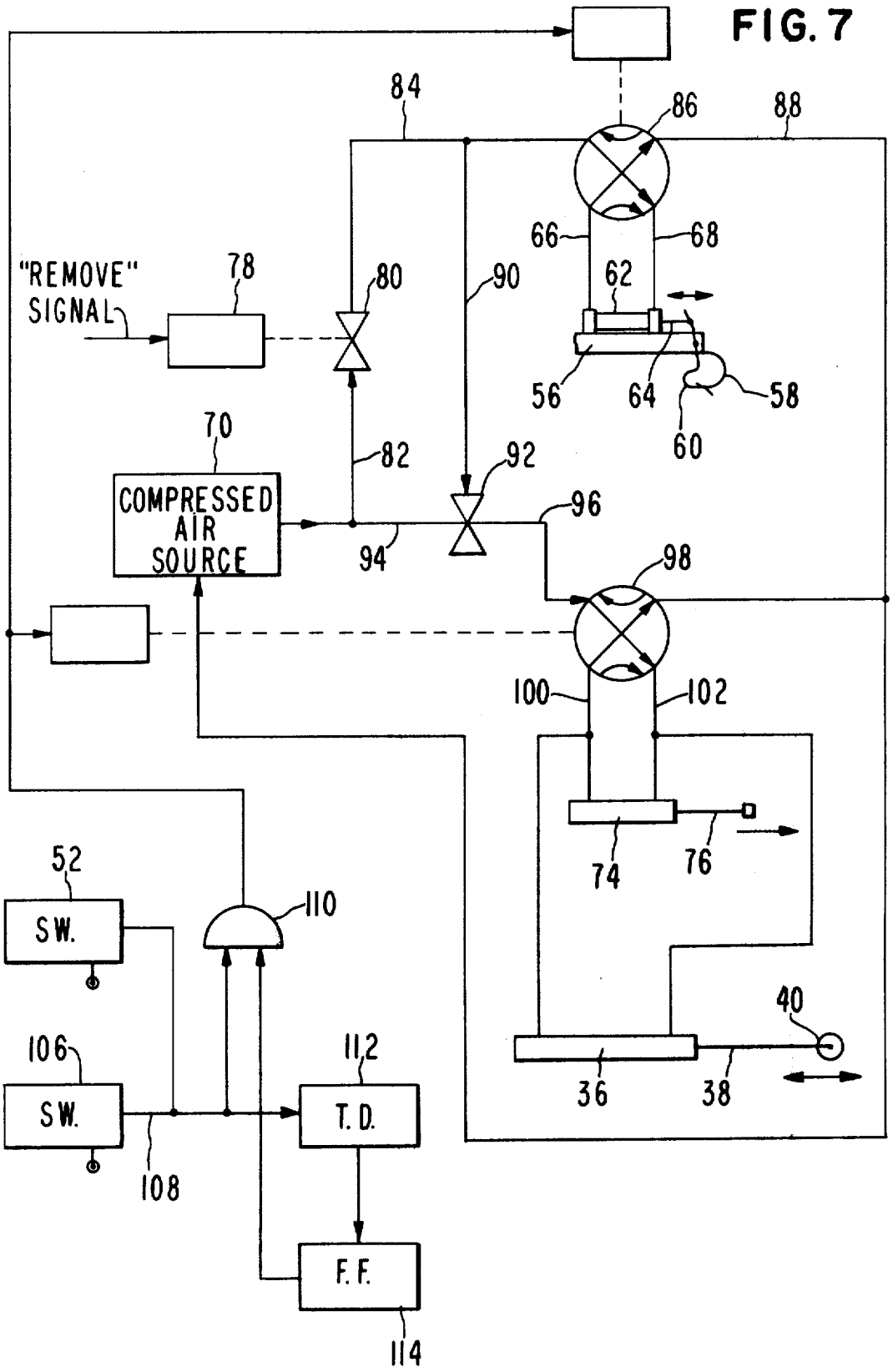
FIG. 7 is a block diagram of the control system for the modified embodiment of FIG. 6.

Referring now more particularly to FIGS. 6 and 7, a modified embodiment of the invention is depicted which allows the mechanism to drop pieces of cloth into two different stacks, such as "right" and "left" pockets, for example. In this embodiment a second reversal switch 106 is mounted on the horizontal leg 20 above the tubular support 24 for engagement with the cam member 50 mounted on the carriage 26. The switch 106 is mounted between the reversal switch 52 and the work surface 14. The surface 106 is connected to the actuator control circuitry by a cable 108.

In operations where it is desired to stack the lengths of material into two separate stacks the switch 106 and the switch 52 are sequentially operated to alternately cause the gripper actuator 62 to release the lengths of material first into one stack and then into another. The manner in which the switches 52 and 106 operate the gripper and carriage mechanism will de described in greater detail with reference to FIG. 7. It should be noted that the relative positions of the switches 52 and 106 can be movable by providing movable mounting brackets on the leg 20. The position of the switches relative to the tote box 16 are adjustable to achieve the results described above.

Referring now more particularly to FIG. 7, the control circuitry is basically the same as that described in reference to FIG. 5 and similar reference numerals have been applied. The basic modification of the control circuit of FIG. 5 lies in the connection of the switch 52 and the addition of the switch 106 and certain logic elements. The outputs from the switches 52 and 106, which are on or off signals, are fed to one input of an AND gate 110 and to one input of a time delay circuit 112. Although not shown in detail in the diagram, it is to be understood that closing of either of the switches 52 or 106 produces an appropriate control signal, such as a predetermined voltage rise, to activate the logic circuitry 110, 112 and 114. Alternatively, by using other biasing circuits, the closing of the switches could produce a cessation of such a voltage. The output of the time delay circuit 112 is fed to the input of the flip-flop 114 whose output is fed to the other input of the AND gate 110. The output of the AND gate 110 is used to control the four-way valves 86 and 98.

The control operation for releasing the lengths of cloth into alternate stacks is basically a function of the position of the switches 106 and 52 with respect to the tote box 16. The switches 106 and 52 are positioned over the areas where it is desired to have the two separate stacks.

The operation of the logic circuitry depicted in FIG. 7 is as follows. Assuming that the flip-flop 114 is in a zero state, which for the purposes of this description means that it has a zero voltage output, then when the carriage first moves from the working surface 14 outwardly along the tubular support 24, the camming member 50 will first activate the switch 106 causing a logic high, which for the purposes of this description means a predetermined voltage level which is either positive or negative depending on the circuitry used. This logic high is fed to one input of the AND gate 110 and to the time delay circuit 112. Since the input to the AND gate 110 at this point is a logic high from the switch 106 and a low from the flip-flop 114, no output will be produced from the AND gate 110. The carriage 26 will thus pass by the switch 106 without activating either of the valves 86 or 98. The pulse from the switch 106 does, however, pass through the time delay circuit 112 to activate the flip-flop 114 and change its output state to a logic high after the carriage 26 has passed the switch 106.

When the carriage 26 has traveled a sufficient distance along the tubular support 24 to place the camming member 50 in contact with the switch 52, a logic high is supplied to one input of the AND gate 110 from the switch 52 and a logic high is supplied from the output of the flip-flop 114 to the other input of the AND gate 110. With these two high inputs to the AND gate 110 an activating signal is produced at the output of the AND gate which causes the valves 86 and 98 to be operated. In this case, operation of the valves 86 and 98 causes the gripper actuator 62 to release the first held length of web material and the pneumatic actuator 36 to retract the rod 44 and thereby cause the carriage 26 to return to the working surface 14. The activation of the switch 52, in addition to causing the gripper to release the length of material and the carriage to reverse its direction of travel, also sends a delayed pulse through the circuit 112 to change the state of the flip-flop 114 to a zero or low state. During the return travel of the carriage 26 to the working surface 14, it will again activate the switch 106 which, because of the zero state of the flip-flop 114, will not activate the valves 86 and 98, but will feed a delayed pulse through the circuit 112 to again change the state of the flip-flop 114 to a logic high.

On the next succeeding "outbound" trip of the carriage 26 along the tubular support 24 from the working surface 14, when the switch 106 is activated by the camming member 50, a logic high is fed to one input to the AND gate 110 from the switch 106 and a second logic high is fed to its other input from the flip-flop 114. Thus the output of the flip-flop 114 will cause the valves 86 and 98 to be activated, thereby releasing the second length of web material from the gripper mechanism and causing the carriage movement mechanism to reverse its direction of travel. It will be noted that all of this takes place when the camming member 50 contacts the switch 106 so that the second length of material is being released at a different point along the length of travel of the carriage 26 on the tubular support 24 than the release point of the first held length of cloth.

After the carriage returns to the working surface 14, the whole sequence described above will be repeated so that the carriage will travel first to one switch and then reverse and then to the other switch before being reversed. Likewise, the gripper mechanism will be activated first by one switch and then the other in alternate trips of the carriage.

While a particular control circuit has been described above, it should be apparent that in other embodiments other types of logic control and valve arrangements may be utilized to accomplish the same purposes. Furthermore, in other embodiments the switches 52 and 106 may be replaced by other sensing devices such as photosensors, for example, which may, or may not, be mounted directly on the frame 20.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. A mechanism for gripping and moving lengths of pliable fabric from a stationary working surface to a storage location, the mechanism comprising an elongated frame having one end adjacent to the working surface and its other end adjacent the storage location;

a carriage movable on the frame from the one end to the other end;

gripper means mounted on the carriage for gripping the lengths of fabric;

means responsive to a first control signal for activating the gripper means to grip the fabric lengths;

means for moving the carriage on the frame from the one end toward the other end and back again, carriage movement controlling means controlled in part by the gripper activating means for initially causing the carriage moving means to move the carriage away from the one end at a first speed after the gripper means has gripped a length of fabric, pausing, and then continuing to move the carriage toward the other end at a second speed which is slower than the first speed.

2. A gripping mechanism as recited in claim 1 further comprising a first extension rod, means for clamping one end of the first rod to the carriage, the gripper means including a second extension rod, means for attaching one end of the second extension rod to the distal end of the first rod, the second extension rod having a curved portion at its other end, the curved portion having an outer curved surface for sliding over the lengths of fabric on the working surface, a clamping member pivotally mounted on the end of the second extension rod adjacent to the curved portion, the clamping member having one end which can lift an edge of a length of fabric and press it against the outer surface of the curved portion when the clamping member is caused to pivot towards the curved portion, and first actuator means for selectively causing the clamping member to pivot towards the curved portion.

3. A gripping mechanism as recited in claim 2 wherein the location of attachment of the second extension rod to the first extension rod is adjustable.

4. A gripping mechanism as recited in claim 1 wherein the carriage movement controlling means automatically causes the carriage moving means to reverse the carriage direction and deactivates the gripper means at a first selected point on the frame and then at second selected point on the frame, in succession.

5. A gripping mechanism as recited in claim 4 wherein the gripper means releases gripped lengths of fabric in response to a second control signal and wherein the carriage moving means comprises two way actuator means for moving the carriage back and forth on the frame from its original position in response to the first control signal and a second control signal, respectively, and the carriage movement controlling means includes first and second switch means attached to the frame at spaced apart locations along the direction of carriage travel for producing output signals when actuated by the moving carriage, bistable logic means having an input supplied with both of the outputs of the first and second switch means, the bistable logic means producing a delayed output signal for every other succeeding signal supplied to its input from the first and second switch means, the delay in the output signal being sufficient to allow the carriage to pass by the first and second switch means which last supplied the input signal to the bistable logic means, and AND gate logic means having one input connected to the output of the bistable logic means, another input connected to both the carriage actuator means and the gripper means, the AND gate means producing the second control signal to simultaneously operate the carriage actuator to return the carriage to its original position and to cause the gripper means to release whenever the AND gate means receives simultaneous inputs from one of the first and second switch means and the output of the bistable logic means.

6. A mechanism for gripping and removing lengths of sewn fabric from a sewing machine working surface, comprising a frame;

a carriage movable on the frame;

a first extension member attached to the carriage;

gripper means mounted on the distal end of the first extension member from the carriage for gripping the lengths of web material;

means for selectively activating the gripper means; and means for automatically moving the carriage on the frame between the working surface and a sequence of preselected points on the frame, including means for initially moving the carriage at a predetermined first speed for a predetermined time after the gripper means are activated, pausing to allow cutting of any threads extending from the sewing machine to the fabric, and then moving the carriage at a second speed which is slower than the first speed.

7. A gripping mechanism as recited in claim 6 wherein the carriage moving means are responsive to the gripper activating means such that the carriage is moved only after the gripper means are activated.

8. A gripping mechanism as recited in claim 6 further comprising adjustable control means for simultaneously causing the gripper means to release a held length of web material and for reversing the direction of carriage travel alternately at two of the preselected points along the direction of travel of the carriage on the frame.

9. A gripping mechanism as recited in claim 6 wherein the carriage moving means includes first and second actuator means for moving the carriage along the frame and means for operating the first and second actuator means moving the carriage at the first speed a predetermined distance along the frame as the carriage travels away from the working surface and the second actuator means thereafter moving the carriage at the second speed along the frame between the end of the predetermined distance and one of the sequence of points and then back to the working surface.

* * * * *